US007225736B2

(12) United States Patent
Blom et al.

(10) Patent No.: US 7,225,736 B2
(45) Date of Patent: Jun. 5, 2007

(54) PRINTING MACHINE

(75) Inventors: Robert Blom, Tecklenburg (DE); Dietmar Koopmann, Lienen-Kattenvenne (DE); Guenter Rogge, Lienen (DE)

(73) Assignee: Windmoeller & Hoelscher KG, Lengerich (DE)

( * ) Notice: Subject to any disclaimer, the term of this patent is extended or adjusted under 35 U.S.C. 154(b) by 153 days.

(21) Appl. No.: 10/512,488

(22) PCT Filed: May 8, 2003

(86) PCT No.: PCT/EP03/05064

§ 371 (c)(1),
(2), (4) Date: Oct. 26, 2004

(87) PCT Pub. No.: WO03/095205

PCT Pub. Date: Nov. 20, 2003

(65) Prior Publication Data

US 2005/0166774 A1 Aug. 4, 2005

(30) Foreign Application Priority Data

May 8, 2002 (DE) ..... 102 20 608

(51) Int. Cl.
*B41F 5/00* (2006.01)

(52) U.S. Cl. ..... 101/216; 101/375

(58) Field of Classification Search ..... 101/216, 101/217, 375, 376, 382.1, 383
See application file for complete search history.

(56) References Cited

U.S. PATENT DOCUMENTS 4,030,415 A * 6/1977 Fellows ..... 101/382.1
4,461,663 A * 7/1984 Tachibana et al. ..... 156/86
4,823,693 A * 4/1989 Kobler ..... 101/218
5,289,769 A * 3/1994 Lewis ..... 101/218
5,370,047 A * 12/1994 Compton ..... 101/216
5,802,975 A * 9/1998 Prem et al. ..... 101/375
5,974,968 A 11/1999 Achelpohl
6,386,103 B1 5/2002 Charette et al.

(Continued)

FOREIGN PATENT DOCUMENTS

DE 43 41 246 C1 2/1995

(Continued)

*Primary Examiner*—Ren Yan
(74) *Attorney, Agent, or Firm*—Jacobson Holman PLLC

(57) ABSTRACT

The bearings of a printing roller of a printing machine, preferably of a flexoprinting machine, with at least one counter-pressure cylinder and with at least one printing roller, which on one end is taper bore mounted in the frame, are conveyable in guideways relative to the counter-pressure cylinder. A bearing is provided for underpropping the shaft extension of the free end of the printing roller. In order to be able to slide the enveloping sleeve off and/or the adapter sleeve off of the printing roller in a simple manner, two shafts are mounted to be longitudinally displaceable and rotatable in the bearing block in which the printing roller is taper bore mounted, parallel to the center line of the printing roller, said shafts carrying on their inner ends, which are oriented toward the printing roller, radial arms with end face thrust pieces. The shafts are rotatably mounted on their outer ends in a carrier bracket and are provided with a rotary drive. The carrier bracket is provided with a drive that makes it conveyable relative to the bearing block.

19 Claims, 4 Drawing Sheets

U.S. PATENT DOCUMENTS

| | | | | |
|---|---|---|---|---|
| 6,401,615 | B1 | 6/2002 | Heinicke | |
| 6,647,879 | B1 * | 11/2003 | Papadopoulos et al. | 101/376 |
| 6,789,479 | B2 * | 9/2004 | Gottling et al. | 101/375 |
| 6,792,858 | B2 * | 9/2004 | Kolbe et al. | 101/376 |

FOREIGN PATENT DOCUMENTS

| | | | |
|---|---|---|---|
| DE | 195 00 729 | A1 | 7/1995 |
| DE | 197 05 369 | A1 | 9/1998 |
| DE | 198 46 677 | A1 | 4/2000 |
| DE | 200 10 068 | U1 | 11/2000 |
| DE | 100 44 909 | A1 | 4/2001 |
| EP | 1 080 890 | A1 | 3/2001 |
| EP | 1 090 754 | B1 | 8/2003 |

* cited by examiner

PRINTING MACHINE

This is a nationalization of PCT/EP03/05064 filed May 8, 2003 and published in German.

BACKGROUND OF THE INVENTION

1. Field of the Invention

The invention concerns a printing machine, preferably a flexoprinting machine, with at least one counter-pressure cylinder and with at least one printing roller fitted with one adapter sleeve and/or with one enveloping sleeve, wherein the bearings of the printing roller are conveyable in guideways relative to the counter-pressure cylinder and a bearing is provided to underprop the shaft extension of the free end of the printing roller.

2. Description of the Related Art

Such a printing machine, for example, is known from the German patent DE 197 05 369 A1, in which the bearing block with the underprop bearing for the printing roller is conveyable in the printing machine frame transverse to the printing roller, so that the taper bore mounted printing roller is clearly accessible from one side, for example, through a window on the side stand of the printing machine frame, so that an enveloping sleeve and/or an adapter sleeve for the enveloping sleeve can be pushed out and fitted on.

For example, in order to separate enveloping sleeves covered with cliches and/or adapter sleeves from one another, and/or to push them off of a printing roller and then to be able to slide them back on again, it is known, for example, from the German patents DE 198 46 677 A1 and DE 200 10 068 A1, that said enveloping sleeves and/or adapter sleeves can be hydraulically expanded or contracted by the use of compressed air. In spite of the possibility of expanding the enveloping sleeves and/or adapter sleeves for the purpose of fitting them on and off, considerable means of force are expended to this end.

SUMMARY OF THE INVENTION

The task of the invention is therefore to create a printing machine of the type described in the introduction, in which the enveloping sleeve and/or the adapter sleeve can be pushed off from the printing roller in a simple manner.

In accordance with the invention, this task is resolved in that, for the purpose of changing the relative position of the adapter sleeve and/or of the enveloping sleeve and of the printing roller in the bearing block, in which the printing roller is taper bore mounted, parallel to the center line of the printing roller, there is at least one shaft, but preferably there are two shafts, mounted to be longitudinally displaceable and rotatable, said shafts carrying radial gripping arms on their inner ends that are oriented toward the printing roller.

The radial arms are purposefully provided with thrust pieces on the end faces.

The shafts can be rotatably supported on their outer ends by a carrier bracket and can be provided with a rotary drive.

The carrier bracket is purposefully provided with a drive for the purpose of making it slide relative to the bearing block.

The task described above is thereby resolved in the case of a printing machine, preferably of a flexoprinting machine, with at least one counter-pressure cylinder and with at least one printing roller, which on one end is taper bore mounted in the frame, wherein the bearings of the printing roller are conveyable in guideways relative to the counter-pressure cylinder and a bearing is provided to underprop the shaft extension of the free end of the printing roller, in that, in accordance with the invention, in the bearing block in which the printing roller is taper bore mounted, parallel to the sleeve line of the printing roller, two shafts are mounted to be longitudinally displaceable and rotatable, which carry on their inner ends that are oriented toward the printing roller radial arms with end face thrust pieces, that the shafts are mounted on their outer ends to be rotatable in a carrier bracket and are provided with a rotary drive, and that the carrier bracket is provided with a drive that makes it conveyable relative to the bearing block.

In the printing machine in accordance with the invention, after the withdrawal of the underprop bearing from under the free end of the taper bore mounted printing roller, an enveloping sleeve and/or an adapter sleeve can be pushed off from said printing roller in a simple manner, in that the thrust pieces are brought into an appropriate emplacement on the end zones of the enveloping sleeve and/or of the adapter sleeve by axial traverse and radial swing, so that subsequently, by axial traverse of the thrust pieces relative to the printing roller, the enveloping sleeve and/or the adapter sleeve can be pushed off of the printing roller.

Advantageously, the rotary drive comprises a piston cylinder pressure medium unit whose cylinder and piston rod are respectively linked on the ends of the radial levers of the shafts. In this fashion, the radial levers are endowed with a clamp-like opening or closing movement in a simple manner.

Preferably, the drive conveying the carrier bracket in the axial direction relative to the printing roller comprises at least one piston cylinder pressure medium unit whose ends engage down on the carrier bracket and on the bearing block.

According to a further developed embodiment of the invention, it is provided that a piston cylinder pressure medium unit with a short stroke cylinder and a piston cylinder pressure medium unit with a long stroke cylinder are coupled with one another and the outer faces are connected to the carrier bracket on the one side and to the bearing block on the other side. In this design, the short stroke cylinder serves to apply the thrust pieces in the proper position on the enveloping sleeve and/or on the adapter sleeve, and the long stroke cylinder serves to push off the enveloping sleeve and/or the adapter sleeve from the printing roller and given the case, to also fit them on.

To facilitate a mode of construction that is as short as possible, the long stroke cylinder is purposefully mounted in a bore on the bearing block.

The thrust pieces are purposefully adapted to the form of the enveloping sleeve and/or of the adapter sleeve to be pushed off of the printing roller.

For pushing off and also for fitting on the enveloping sleeve or the adapter sleeve on to the printing roller, the enveloping sleeve can be provided with an annular T-slot on its end zone oriented toward the bearing block, upon which the printing roller is taper bore mounted, and the thrust pieces can be provided with keys that engage into this annular T-slot.

BRIEF DESCRIPTION OF THE DRAWINGS

An exemplary embodiment of the invention is more closely detailed with the aid of the following drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
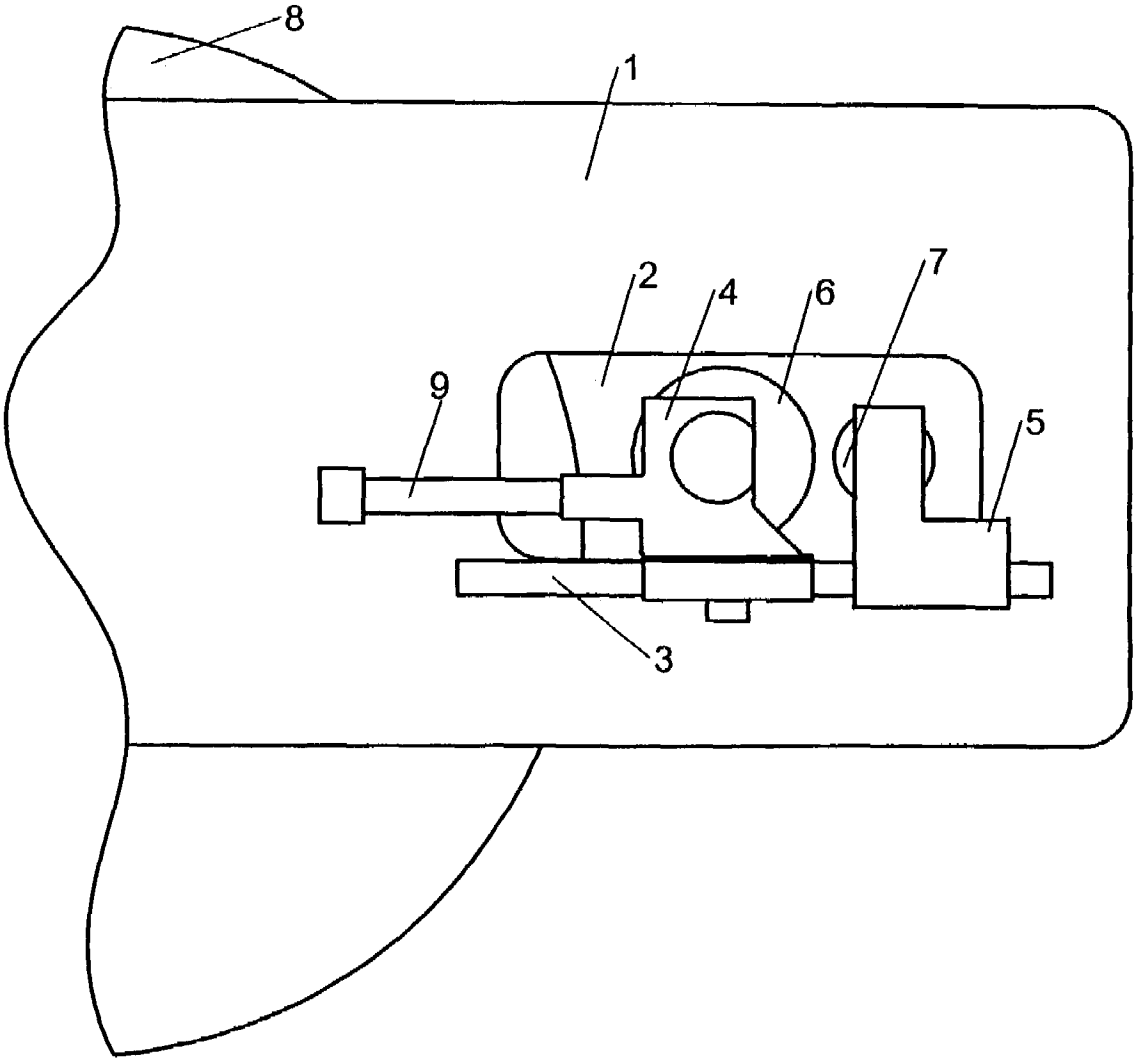
FIG. 1A shows a side view of a side stand of a flexoprinting machine in which the bearing blocks of a printing roller and of an anilox roller are mounted, which are adjustable in terms of one another and in terms of a counter-pressure cylinder.

In FIG. 1, a side view can be seen of the one front side stand out of two overhanging side stands 1 that are joined to the printing machine frame, which are provided with windows forming cutouts 2, in whose proximity the bearing blocks 4, 5 of a printing roller 6 and of an anilox roller 7 are mounted on guide rails 3 to be conveyable in such a manner, that the anilox roller 7 next to the printing roller 6 can be adjusted in terms of its proximity or distance to the latter and the printing roller 6 can be adjusted by itself or together with the anilox roller 7 in terms of relative distance to the counter-pressure cylinder 8. Both of the bearing blocks 4 for the printing roller 6 are conveyable by means of spindle drives 9. The drives for the bearing blocks 5 of the anilox roller are not represented.

Figure 2:
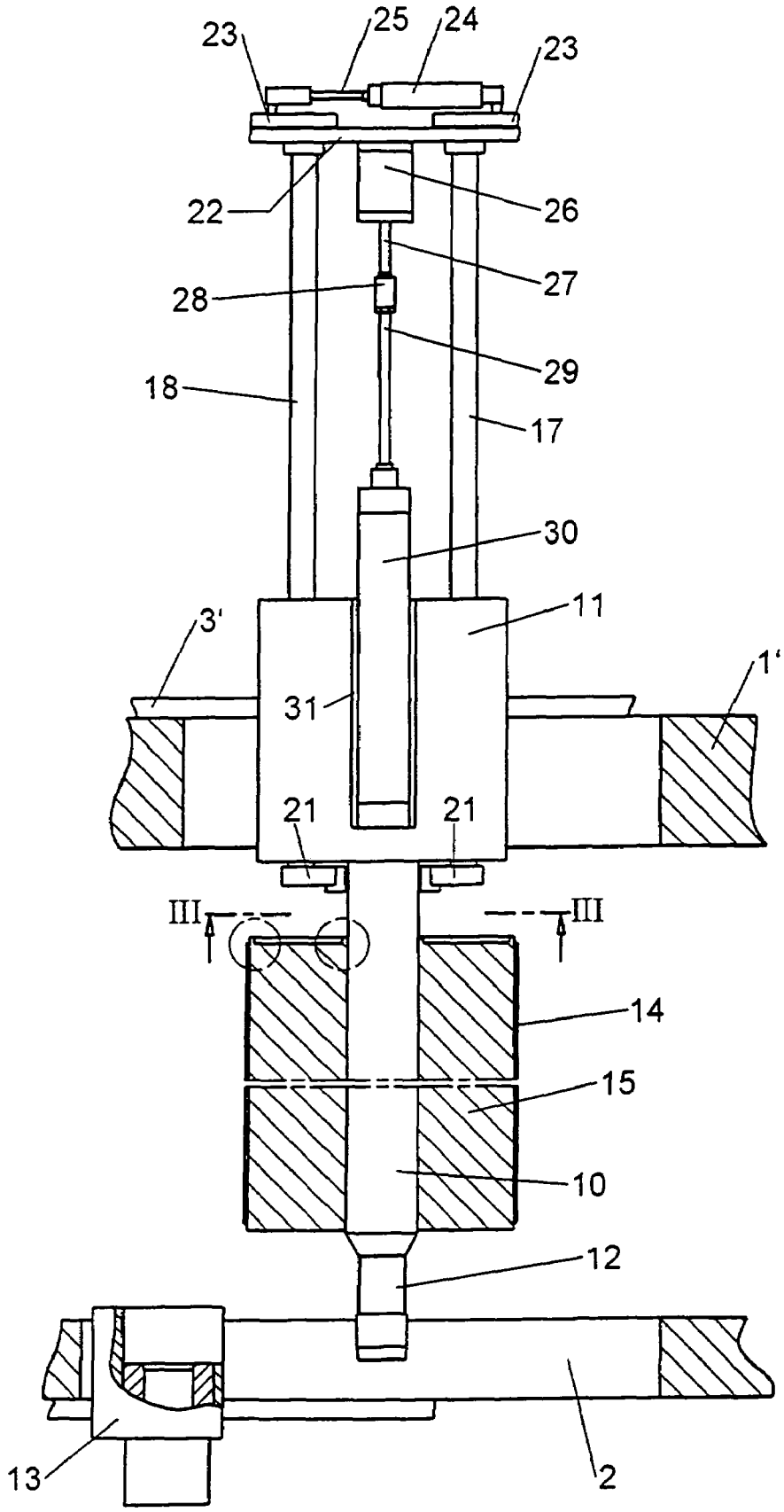
FIG. 2A shows a top view of a printing roller that is taper bore mounted in a side stand with a removed underprop bearing and with a device for pushing off an enveloping sleeve and/or an adapter sleeve from the printing roller, in schematic representation.
Figure 3:
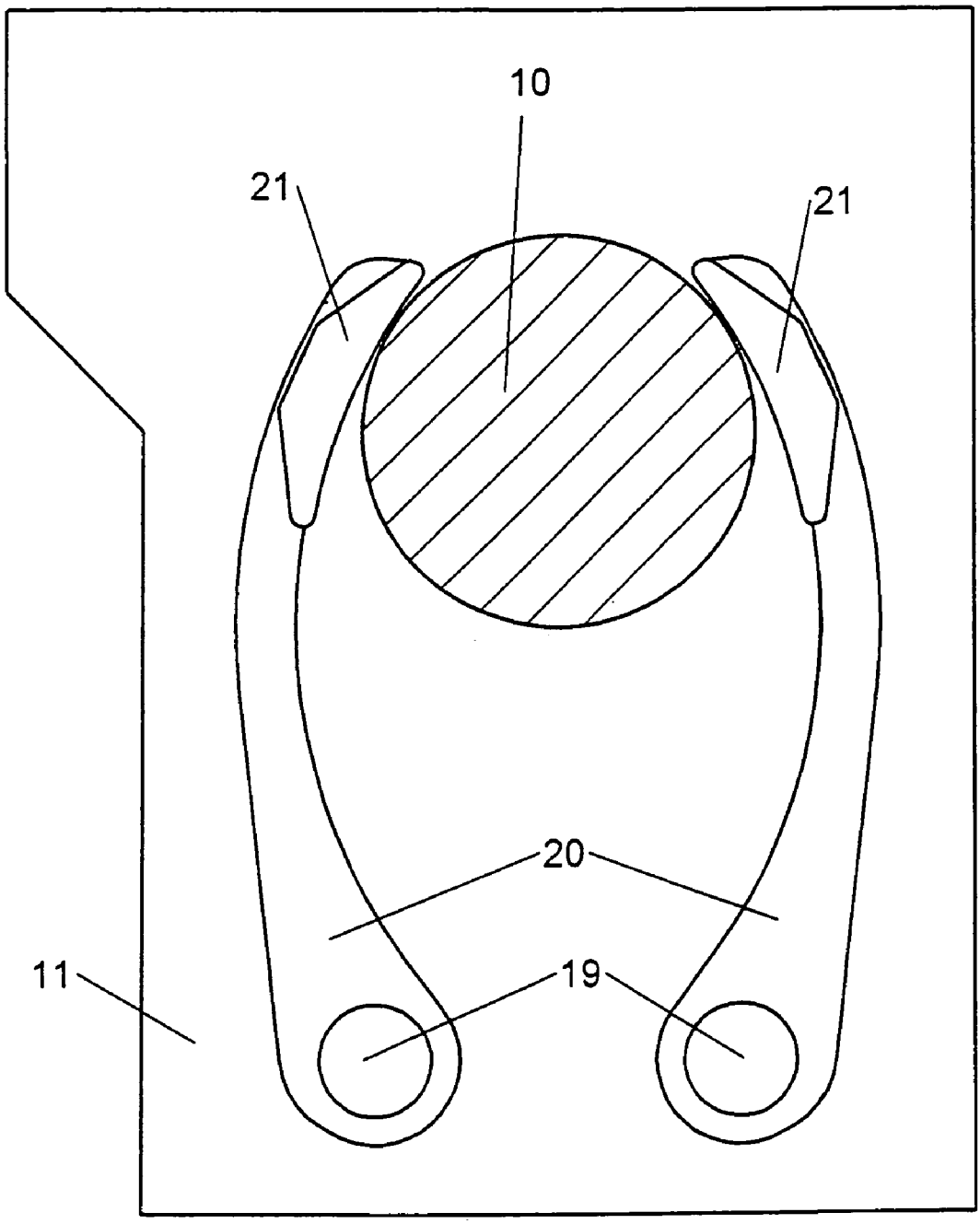
FIG. 3A is a section through the printing roller along line III—III in FIG. 2.

As shown in FIG. 2, the printing roller 10 is taper bore mounted in a bearing block 11, which is conveyably guided on guide rails 3' in the rear side stand 1'. The front shaft extension 12 of the printing roller 10 is mounted in an underprop bearing 13 during the printing operation, which is removed from the shaft extension 12 in the position shown in FIG. 2 and conveyed off to the side, so that the printing roller and the enveloping sleeve 14 mounted on said printing roller and the adapter sleeve 15 carrying said enveloping sleeve are freely accessible through the window 2 of the front side stand 1. The type of bearing arrangement for the shaft extension 12 of the printing roller 10 in the underprop bearing 13 and the release of the shaft extension 12 from the underprop bearing 13 and the lateral conveyance of this underprop bearing are known in the German patents DE 197 05 369 A1, to which reference shall be made for a more detailed representation.

In the bearing block 11, beneath the printing roller 10, are the shafts 17, 18, parallel to one another and distanced apart and guided to be longitudinally displaceable and rotatable, and mounted symmetrically on a vertical plane, intersecting the center line of the printing roller 10. Tong-like radial arms 20 are unrotatably secured on the front ends 19 of the shafts 17, 18 penetrating the bearing block 11, whose freely upward projecting ends carry jaws in the form of thrust pieces 21.

The back ends of the shafts 17, 18 are rotatably mounted in a plate-shaped carrier bracket 22, but are axially undisplaceable. On the rear shaft extensions of the shafts 17, 18, penetrating the carrier bracket 22, are radial levers 23 unrotatably secured, on whose free ends the cylinder 24 is mounted on the one side and the piston rod 25 on the other, both of a piston cylinder pressure medium unit. Secured on the carrier bracket 22 is the short stroke cylinder 26 of a piston cylinder pressure medium unit, whose piston rod 27 is connected by a coupling piece 28 to the piston rod 29 of a long stroke cylinder 30 of a piston cylinder pressure medium unit, said long stroke cylinder being secured in a bore 31 of the bearing block 11.

The jaws or the thrust pieces 21 carry padded or cushioning pieces 22 on their ends that serve for the gentle emplacement of the thrust pieces on the enveloping sleeve 14 or on the adapter sleeve 15.

In the position shown in FIG. 4B, the thrust piece 21 is positioned on the forward front face of the adapter sleeve 15 based on the corresponding outward extension of the short stroke cylinder 26 and the horizontal swing of the arms 20, so that upon activation of the long stroke cylinder 30, the adapter sleeve 15 can be pushed off from the printing roller 10. FIG. 4B shows the part that is encircled on the right side in FIG. 2.

FIGS. 4A, C and D show the modes of operation for the part that is encircled on the left side in FIG. 2.

Figure 4:
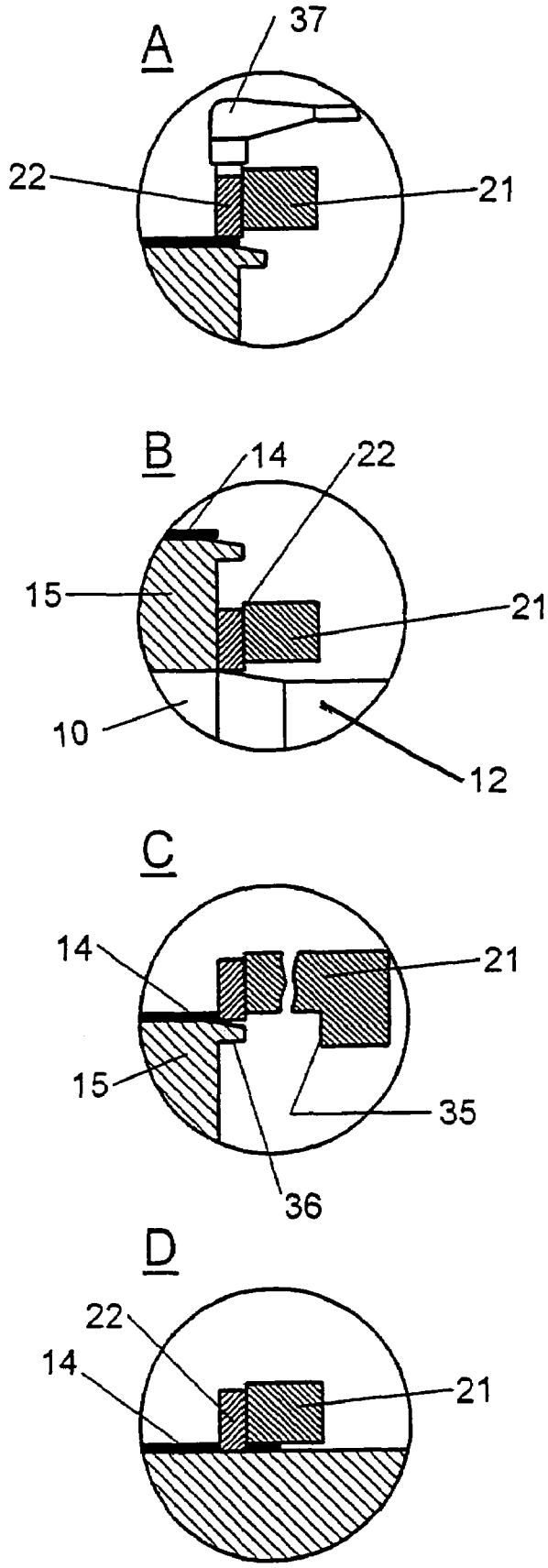
FIGS. 4A through D depict various positions of thrust pieces that are orientable and movable in the axial direction relative to the enveloping sleeves and/or the adapter sleeves to be pushed off.

In accordance with FIG. 4C, the cushioning part 22 of the thrust piece 21 is only applied to the front face of the enveloping sleeve 14, so that initially only the enveloping sleeve can be pushed off from the adapter sleeve 15. The specially designed thrust piece 21 in accordance with FIG. 4 C is provided with an offset 35, which impacts against a ring-shaped shoulder 36 of the adapter sleeve 15 and thereby pushes said adapter sleeve from the printing roller 10, if the enveloping sleeve has already been somewhat pushed from the adapter sleeve 15 by a predetermined distance. This type of step-wise pushing off facilitates handling operations, if the adapter sleeve has been pushed off from the printing roller together with the enveloping sleeve, because then the enveloping sleeve can be more easily removed from the adapter sleeve.

In the exemplary embodiment in accordance with FIG. 4D, the enveloping sleeve 14 is provided with an annular T-slot into which the wedge-shape designed cushioning piece 22 of the thrust piece 21 engages, so that the enveloping sleeve 14 alone is pushed off from the adapter sleeve 15 or also, so that said enveloping sleeve can be fitted over said adapter sleeve.

In accordance with the exemplary embodiment as per FIG. 4A, the thrust piece is provided with a sensor, for example with an optical sensor 37, which detects a mark applied on to the enveloping sleeve, so that the rotational position of the enveloping sleeve can be registered for the print run.

The side registration of the printing mechanism can also be used for adaptation in cases where the short stroke cylinder 26 should not suffice for the adaptation of the thrust pieces 21 on to the enveloping sleeves or adapter sleeves.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A flexographic printing machine comprising at least one counter-pressure cylinder and at least one printing roller fitted with at least one sleeve in a position thereon, said printing roller being taper bore mounted in a bearing block that is conveyable in guideways relative to the counter-pressure cylinder, at least one shaft being mounted in said bearing block parallel to a center line of said printing roller to be longitudinally displaceable and rotatable, said shaft carrying a radial gripping arm on an inner end thereof that is oriented toward the printing roller, said shaft with said radial gripping arm being configured to change the position of the sleeve relative to the printing roller through longitudinal movement of said shaft in said bearing block.

2. The printing machine in accordance with claim 1, further comprising two shafts mounted in said bearing block parallel to the center line of said printing roller, each shaft carrying a radial gripping arm thereon.

3. The printing machine in accordance with claim 2, wherein the radial arms are provided with end face thrust pieces.

4. The printing machine in accordance with claim 3, wherein the thrust pieces are adapted to a form of the sleeve to be pushed off from the printing roller.

5. The printing machine in accordance with claim 2, wherein the shafts are rotatably mounted in a carrier bracket at their outer ends and are provided with a rotary drive.

6. The printing machine in accordance with claim 5, wherein the carrier bracket is provided with a drive for sliding said bracket relative to the bearing block.

7. The printing machine in accordance with claim 6, wherein said rotary drive includes a piston cylinder pressure medium unit having a cylinder and a piston rod that are respectively linked to radial levers on the outer ends of the shafts.

8. The printing machine in accordance with claim 6, wherein the drive conveying the carrier bracket relative to the printing roller includes at least one piston cylinder pressure medium unit having two ends that engage on the carrier bracket and on the bearing block, respectively.

9. The printing machine in accordance with claim 6, further comprising a piston cylinder pressure medium unit with a short stroke cylinder and a piston cylinder thrust medium unit with a long stroke cylinder coupled with one another, outer faces of both said piston cylinder thrust medium units being connected to the carrier bracket on a first side and to the bearing block on a second side.

10. The printing machine in accordance with claim 9, wherein the long stroke cylinder is mounted in a bore of the bearing block.

11. The printing machine in accordance with claim 2, wherein said sleeve includes an adapter sleeve and an enveloping sleeve, said enveloping sleeve being provided with an annular T-slot on an end zone thereof oriented toward the bearing block upon which the printing roller is mounted, said radial arms including end face thrust pieces provided with keys that engage into said annular T-slot.

12. A flexographic printing machine comprising:

a frame with a bearing block;

a counter-pressure cylinder;

a printing roller which is taper bore mounted at one end in the bearing block on said frame, said bearing block being conveyable in guideways relative to the counter-pressure cylinder;

a bearing provided to underprop a shaft extension of a free end of said printing roller;

at least one shaft mounted in said bearing block parallel to a center line of the printing roller so as to be longitudinally displaceable and rotatable, said shaft carrying a radial arm having a free end configured to engage said printing roller; and a drive mechanism configured to rotate said shaft to move said radial arm into engagement with said printing roller and to move said shaft longitudinally relative to the bearing block.

13. The printing machine in accordance with claim 12, wherein an end of said shaft opposite said bearing block is mounted in a carrier bracket and said drive mechanism includes a rotary drive to rotate said shaft.

14. The printing machine in accordance with claim 13, wherein said drive mechanism further comprises a piston cylinder pressure medium unit with a short stroke cylinder and a piston cylinder thrust medium unit with a long stroke cylinder coupled with one another, outer faces of both said piston cylinder thrust medium units being connected to the carrier bracket on a first side and to the bearing block on a second side.

15. The printing machine in accordance with claim 14, wherein the long stroke cylinder is mounted in a bore of the bearing block.

16. The printing machine in accordance with claim 14, further comprising two shafts, each carrying a radial arm having a free end configured to engage said printing roller.

17. The printing machine in accordance with claim 16, further comprising a sleeve fitted on said printing roller, free ends of said radial arms being adapted to a form of said sleeve so that, upon activation of said short stroke cylinder said free ends engage said sleeve and, upon activation of said long stroke cylinder, said free ends push said sleeve off said printing roller.

18. The printing machine in accordance with claim 17, wherein said sleeve is provided with an annular T-slot on an end zone thereof oriented toward the bearing block upon which the printing roller is mounted, said radial arms including end face thrust pieces provided with keys that engage into said annular T-slot.

19. The printing machine in accordance with claim 16, wherein said drive mechanism includes a rotary drive having a piston cylinder pressure medium unit with a cylinder and a piston rod that are respectively linked to radial levers on outer ends of the shafts.

* * * * *